US008723419B2

(12) United States Patent
Saitou et al.

(10) Patent No.: US 8,723,419 B2
(45) Date of Patent: May 13, 2014

(54) MAGNETRON AND DEVICE USING MICROWAVES

(75) Inventors: Etsuo Saitou, Shiga (JP); Nagisa Kuwahara, Shiga (JP); Takanori Handa, Shiga (JP); Takeshi Ishii, Shiga (JP)

(73) Assignee: Panasonic Corporation, Osaka (JP)

( * ) Notice: Subject to any disclaimer, the term of this patent is extended or adjusted under 35 U.S.C. 154(b) by 359 days.

(21) Appl. No.: 13/130,942

(22) PCT Filed: Nov. 20, 2009

(86) PCT No.: PCT/JP2009/006273
§ 371 (c)(1),
(2), (4) Date: May 24, 2011

(87) PCT Pub. No.: WO2010/061565
PCT Pub. Date: Jun. 3, 2010

(65) Prior Publication Data

US 2011/0227480 A1 Sep. 22, 2011

(30) Foreign Application Priority Data

Nov. 27, 2008 (JP) ..... 2008-302771

(51) Int. Cl.
*H01J 25/50* (2006.01)

(52) U.S. Cl.
USPC ..... 315/39.51; 315/39.69; 315/39.75

(58) Field of Classification Search
CPC ..... H01J 23/22
USPC ..... 315/39.51, 39.69, 39.75
IPC ..... H01J 25/587, 23/22
See application file for complete search history.

(56) References Cited

U.S. PATENT DOCUMENTS 4,743,805 A * 5/1988 Takada ..... 315/39.75
5,635,797 A * 6/1997 Kitakaze et al. ..... 315/39.51

(Continued)

FOREIGN PATENT DOCUMENTS

JP 51-113360 U 9/1976
JP 53-003770 A 1/1978
JP 56-156647 A 12/1981
JP 02-018251 U 2/1990

OTHER PUBLICATIONS

International Search Report for International Application No. PCT/JP2009/006273, dated Dec. 15, 2009, 1 page.

*Primary Examiner* — Douglas W Owens
*Assistant Examiner* — Srinivas Sathiraju
(74) *Attorney, Agent, or Firm* — Brinks Gilson & Lione

(57) ABSTRACT

A magnetron includes: an anode cylinder including anode vanes provided at a predetermined interval on an inner peripheral surface thereof; a center lead including a first linear portion, a second linear portion disposed parallel to the first linear portion and disposed out of alignment with the first linear portion in a plane perpendicular to an axial direction of the anode cylinder, and a bent portion which connects the first linear portion to the second linear portion; and a cathode filament supported by the center lead within the anode cylinder and placed coaxially with the anode cylinder. The center lead is formed so as to become bent between the first linear portion and the second linear portion by the bent portion. A position of one anode vane closest to the bent portion is higher than a position of another anode vane with respect to the axial direction.

11 Claims, 8 Drawing Sheets

(56) References Cited

U.S. PATENT DOCUMENTS

| | | | | |
|---|---|---|---|---|
| 5,635,798 | A * | 6/1997 | Ogura et al. | 315/39.71 |
| 6,653,788 | B2 * | 11/2003 | Ogura et al. | 315/39.51 |
| 6,670,761 | B1 * | 12/2003 | Lee et al. | 315/39.69 |
| 6,756,735 | B2 * | 6/2004 | Lee et al. | 315/39.51 |
| 7,026,762 | B2 * | 4/2006 | Shon et al. | 315/39.51 |
| 7,122,773 | B2 * | 10/2006 | Yang | 219/761 |
| 7,220,949 | B2 * | 5/2007 | Lee et al. | 219/761 |
| 7,375,470 | B2 * | 5/2008 | Baek et al. | 315/39.51 |
| 7,906,912 | B2 * | 3/2011 | Ishii et al. | 315/39.51 |
| 2009/0066252 | A1 * | 3/2009 | Higashi | 315/39.51 |
| 2011/0234093 | A1 * | 9/2011 | Higashi | 315/39.51 |

* cited by examiner

MAGNETRON AND DEVICE USING MICROWAVES

This application is a 371 application of PCT/JP2009/006273 having an international filing date of Nov. 20, 2009, which claims priority to JP2008-302771 filed on Nov. 27, 2008, the entire contents of which are incorporated herein by reference.

TECHNICAL FIELD

The present invention relates to a magnetron and a device using microwaves, and more particularly to a magnetron built in a device using microwaves such as a microwave oven.

BACKGROUND ART

Various methods have been proposed to mount magnetron anode vanes to an anode cylinder with superior accuracy.

Patent Document 1 discloses a technique of mounting a plurality of anode vanes to an anode cylinder with high accuracy by use of a jig fitting to the anode cylinder and storing the plurality of anode vanes in a radial manner and another jig in which a pin is press-fitted into a center space defined by the plurality of anode vanes.

Patent Document 2 discloses a technique of forming areas for locking a plurality of anode vanes to an inner peripheral surface of an anode cylinder, thereby enhancing accuracy of mounting positions of the anode vanes.

RELATED ART DOCUMENTS

Patent Documents

Patent Document 1: JP-A-53-3770
Patent Document 2: JP-A-56-156647

SUMMARY OF THE INVENTION

Problem to be Solved by the Invention

However, the techniques described in Patent Documents 1 and 2 merely enhance accuracy in mounting the anode vanes. In other words, the techniques do not determine the mounting positions of the anode vanes in consideration of a case where a magnetron is actually operated.

When a magnetron is actually operated, a member housed in the anode cylinder, for example, a center lead, is considered to become slightly deformed by thermal expansion with heat developing from a cathode filament. Consequently, an inner diameter of the anode vanes is considered to go out of alignment with a center axis of the cathode filament, which may in turn destroy the balance of working space among the anode vanes, so that a reactive current and noise is more likely to occur.

An object of the present invention is to provide a magnetron capable of suppressing generation of a reactive current and noise thereby improving oscillation efficiency during operation of the magnetron, and a device using microwaves which utilizes the magnetron.

Means for Solving the Problem

The present invention provides a magnetron comprising: an anode cylinder comprising a plurality of anode vanes disposed at a predetermined interval on an inner peripheral surface thereof; a center lead comprising a first linear portion, a second linear portion which is disposed parallel to the first linear portion and which is disposed out of alignment with the first linear portion in a plane perpendicular to an axial direction of the anode cylinder, and a bent portion which connects the first linear portion to the second linear portion; and a cathode filament which is supported by the center lead within the anode cylinder and which is placed coaxially with the anode cylinder, wherein the center lead is formed so as to become bent between the first linear portion and the second linear portion by the bent portion, and wherein a position of one anode vane closest to the bent portion is higher than a position of another anode vane with respect to the axial direction of the anode cylinder.

In the magnetron, positions of the plurality of anode vanes become lower stepwise in the axial direction of the cylindrical anode from the one anode vane to the another anode vane.

When the magnetron operates, a component of a direction in which the cathode filament becomes inclined because of thermal expansion of the bent portion of the center lead on a direction perpendicular to the axial direction of the anode cylinder is identical with a component of a curved direction of the center lead on the direction perpendicular to the axial direction.

In the magnetron, an antenna lead is connected to the one anode vane.

A device using microwaves of the present invention comprises the magnetron.

Advantages of the Invention

The magnetron of the present invention and the device using microwaves which uses the magnetron can suppress generation of a reactive current and noise thereby improving oscillation efficiency during operation of the magnetron.

MODE FOR CARRYING OUT THE INVENTION

An embodiment of the present invention is hereunder described by reference to the drawings.

Figure 1:
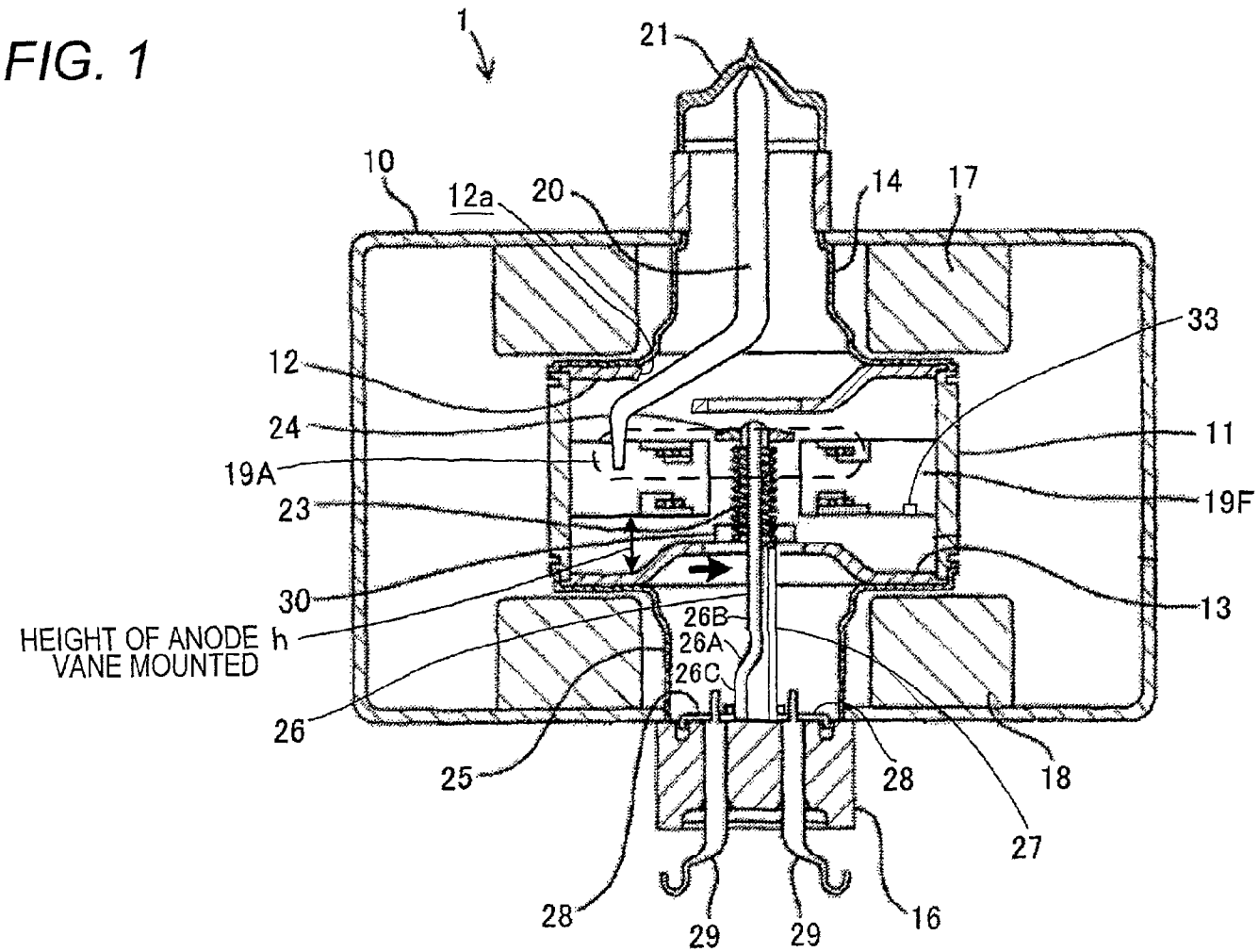
FIG. 1 is a diagram showing an entire configuration of a magnetron 1 of an embodiment.

FIG. 1 is a diagram showing an entire configuration of a magnetron 1 of the present embodiment.

In FIG. 1, the magnetron 1 of the embodiment includes a magnetic yoke 10; a anode cylinder 11; an output pole piece 12 coupled to an upper-end opening of the anode cylinder 11; an input pole piece 13 coupled to a lower-end opening of the anode cylinder 11; an output side tube 14 that covers the output pole piece 12 and that is hermetically coupled to the upper-end opening of the anode cylinder 11; an input side tube 25 that covers the input pole piece 13 and that is hermetically coupled to the lower-end opening of the anode cylinder 11; a ceramic stem 16 hermetically coupled to an opening end of the input side tube 25; a doughnut-shaped annular magnet 17 that is placed on an upper surface of the magnetic yoke 10 and within the same so as to be inserted into the output side tube 14 at a position immediately above the anode cylinder 11; and a doughnut-shaped annular magnet 18 that is placed on a lower surface of the magnetic yoke 10 and within the same so as to be inserted into the input side tube 25 at a position immediately below the anode cylinder 11. An exhaust pipe 21 is connected to the upper surface of the magnetic yoke 10.

A helical cathode filament 23 extends from an upper end shield 24 to a lower end shield 30 along a center axis of the anode cylinder 11. One end of the cathode filament 23 is fastened to the upper end shield 24, and the other end of the cathode filament 23 is fastened to the lower end shield 30. The cathode filament 23 emits thermo electrons upon application of a voltage from a center lead 26 and a side lead 27, which will be described later.

The center lead 26 made of molybdenum includes: a first linear portion 26B; a second linear portion 26C that is parallel to the first linear portion and that is placed out of alignment with the first linear portion within a plane perpendicular to an axial direction of the anode cylinder; and a bent portion 26A that connects the first linear portion to the second linear portion. In the center lead 26, one end of the first linear portion 26B is connected to the upper end shield 24, and one end of the second linear portion 26C is connected to an exterior tube steel lead 29 by way of a lead relay plate (grommet) 28 placed in a plane orthogonal to a tube axis of the stem 16.

The side lead 27 made of molybdenum connects the lower end shield 30 to the exterior tube steel lead 29 by way of the lead relay plate 28 in parallel with the center axis of the anode cylinder 11. In order to emit thermo electrons from the cathode filament 23, the center lead 26 and the side lead 27 apply a voltage to the cathode filament 23.

One end of an output antenna lead 20 is connected to one anode vane 19A among the plurality of anode vanes 19A to 19J. The output antenna lead 20 extends from the anode vane 19A toward the output pole piece 12 coupled to the upper-end opening of the anode cylinder 11 and further extends upward along the center axis of the anode cylinder 11 by way of a hole 12*a* formed in a portion of a slope of the output pole piece 12. The other end of the output antenna lead 20 is connected to the exhaust pipe 21 situated above the output side tube 14.

Figure 2:
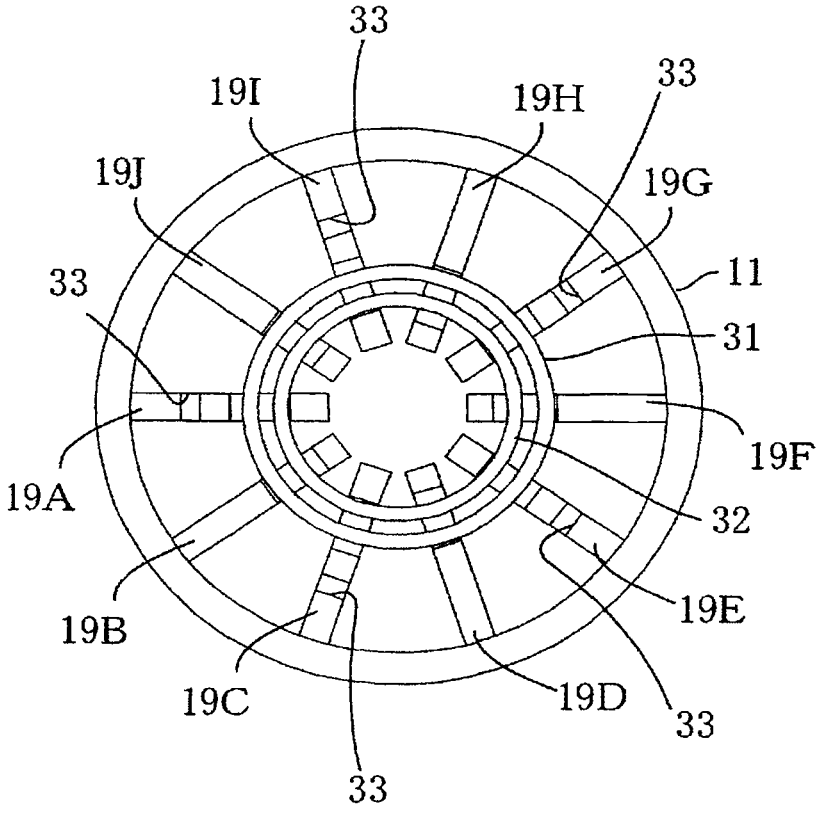
FIG. 2 is a plan view of a plurality of anode vanes 19A to 19J when an inside of an anode cylinder 11 is viewed from above.

A configuration of the plurality of anode vanes 19A to 19J is described by reference to FIGS. 1 and 2. FIG. 2 is a plan view of the plurality of anode vanes 19A to 19J when the inside of the anode cylinder 11 is viewed from above. As shown in FIG. 2, the plurality of anode vanes 19A to 19J are made up of the ten anode vanes 19A to 19J. The ten anode vanes 19A to 19J assume the same shape. Each of the anode vanes 19A to 19J extends from an inner peripheral surface of the anode cylinder 11 to the center axis of the anode cylinder 11. The respective anode vanes 19A to 19J are arranged at a predetermined interval along the inner peripheral surface of the anode cylinder 11. Adjacent anode vanes are arranged in opposite vertical directions.

By reference to FIG. 1, the anode vane 19A among the plurality of anode vanes 19A to 19J comes closest to the bent portion 26A of the center lead 26. As mentioned above, one end of the output antenna lead 20 is connected to the anode vane 19A. The anode vane 19F is situated, with respect to the anode vane 19A, at an imaginary extension of a direction of a component (as designated by an arrow in FIG. 1) of a curved direction of the bent portion 26A of the center lead 26 on a direction perpendicular to the axial direction. As shown in FIG. 2, the anode vane 19F is situated opposite the anode vane 19A on the inner peripheral surface of the anode cylinder 11.

As shown in FIG. 2, equalizing rings 31 and 32 positioned coaxially with the center axis of the anode cylinder 11 are connected to grooves formed in both upper and lower surfaces of the respective anode vanes 19A to 19J. Aside from the grooves to which the equalizing rings 31 and 32 are connected, an antenna pullout groove 33 used for mounting the output antenna lead 20 is formed in the ten anode vanes 19A to 19J.

Figure 3A:
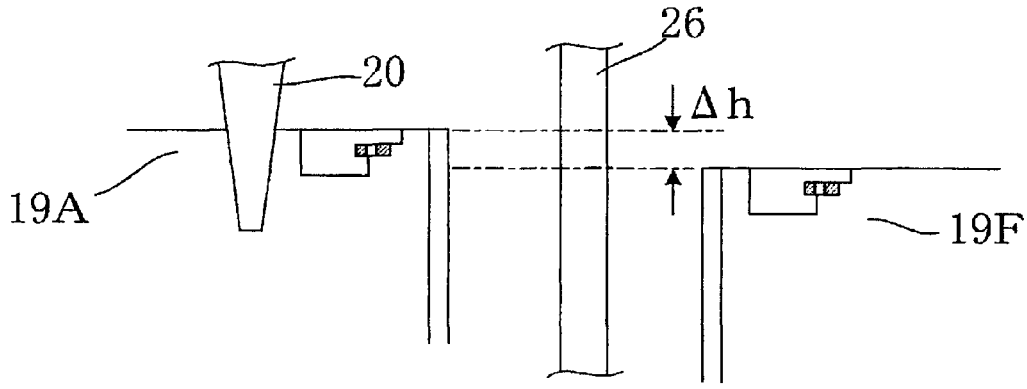
FIG. 3(*a*) is an enlarged partial cross-sectional view of the anode vanes 19A and 19F surrounded by a chain line shown in FIG. 1, and FIG. 3(*b*) is an enlarged cross-sectional view of an area of a related art example magnetron which is the same as that shown in FIG. 3(*a*).
Figure 3B:
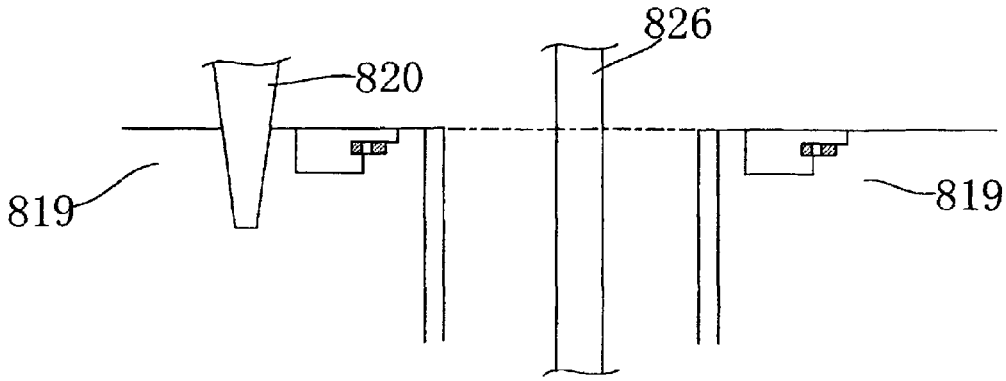

Positions where the respective anode vanes 19A to 19J are to be mounted are now described by reference to FIGS. 3(*a*) and 3(*b*). FIG. 3(*a*) is an enlarged partial cross-sectional view of the anode vanes 19A and 19F surrounded by a chain line shown in FIG. 1, and FIG. 3(*b*) is an enlarged cross-sectional view of an area of a related art example magnetron which is the same as that shown in FIG. 3(*a*). As shown in FIG. 3(*b*), all anode vanes 819 have hitherto been mounted at the same height on an inner peripheral surface of an anode cylinder. However, as shown in FIG. 3(*a*), in the magnetron 1 of the present embodiment, the anode vane 19F located opposite the anode vane 19A is mounted on the inner peripheral surface of the anode cylinder 11 and at a position that is lower, by an amount of Δh, than the anode vane 19A closest to the bent portion 26A of the center lead 26 among the plurality of anode vanes 19A to 19J.

The magnetron 1 of the present embodiment and a comparative example magnetron are compared with each other in connection with an unnecessary radiation level [dB], a reactive current [mA], and oscillation efficiency [%] all of which are achieved when the magnetrons are activated. Samples of the magnetron 1 of the present embodiment used in the respective measurements satisfy at least a relationship between the mounting position of the anode vane 19A and the mounting position of the anode vane 19F shown in FIG. 3(*a*). Further, as shown in FIG. 3(*b*), the comparative example used for measurements is identical in configuration with the magnetron of the present embodiment except all of the plurality of anode vanes 819 are mounted at the same height.

Figure 4:
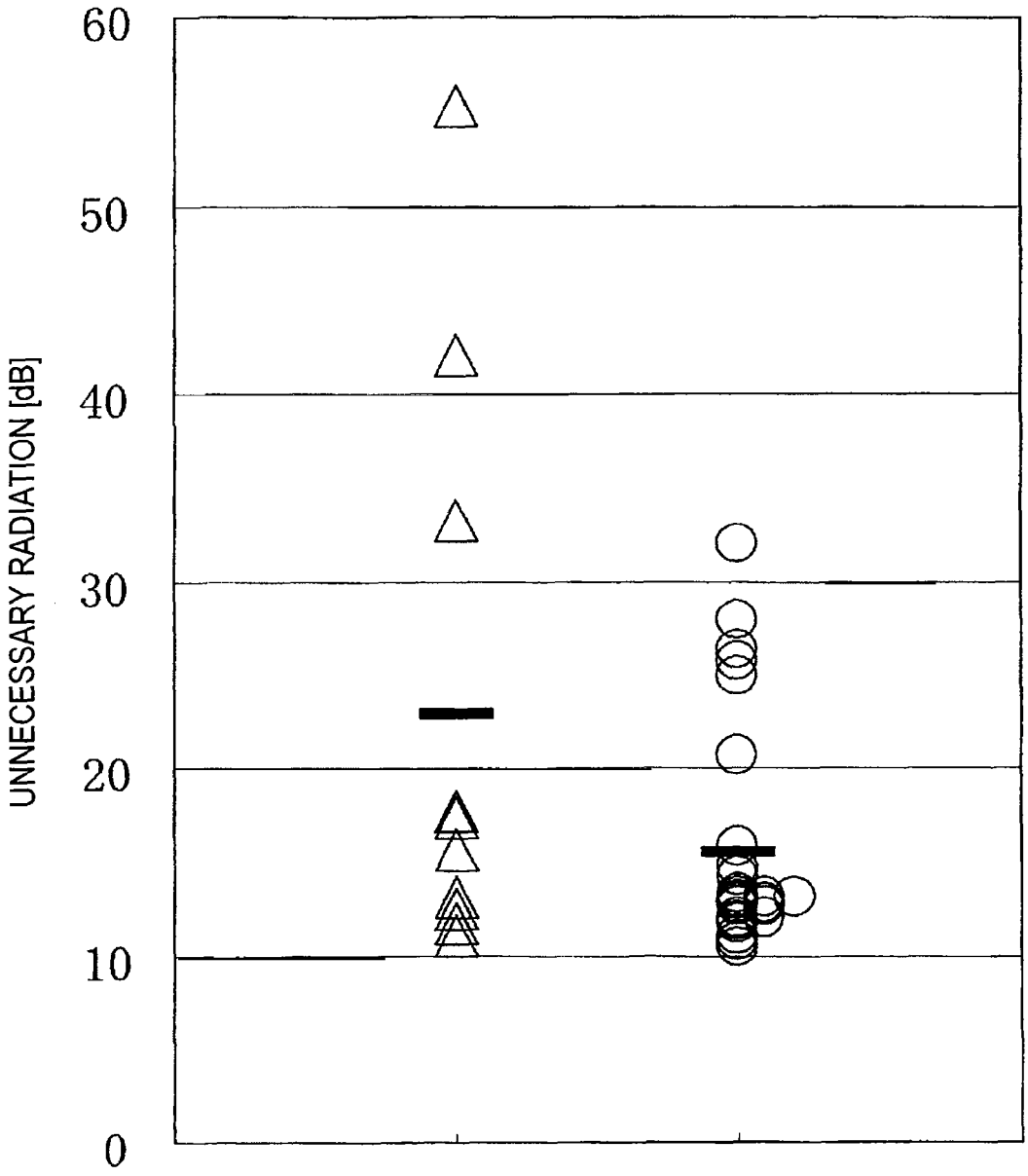
FIG. 4 is a diagram showing results of measurement of unnecessary radiation levels [dB] from samples of the magnetron 1 of the present embodiment and comparative example samples.

FIG. 4 shows results of measurement of unnecessary radiation levels [dB] from samples of the magnetron 1 of the present embodiment and comparative example samples. In FIG. 4, (outlined) circular symbols depict results of measurement of the samples of the magnetron 1 of the embodiment, and a horizontal bar depicts an average of the measurement results. Further, (outlined) triangular symbols in FIG. 4 depict results of measurement of unnecessary radiation from the comparative sample examples, and an (outlined) horizontal bar depicts an average of the measurement results.

As shown in FIG. 4, variations in unnecessary radiation from the samples of the magnetron 1 of the embodiment are smaller than variations in unnecessary radiation from the comparative sample examples. Moreover, the average of unnecessary radiation levels of the samples of the magnetron 1 of the embodiment is about 15.5 [dB] and smaller than the average (about 23 [dB]) of the unnecessary radiation levels of the comparative sample examples.

Figure 5:
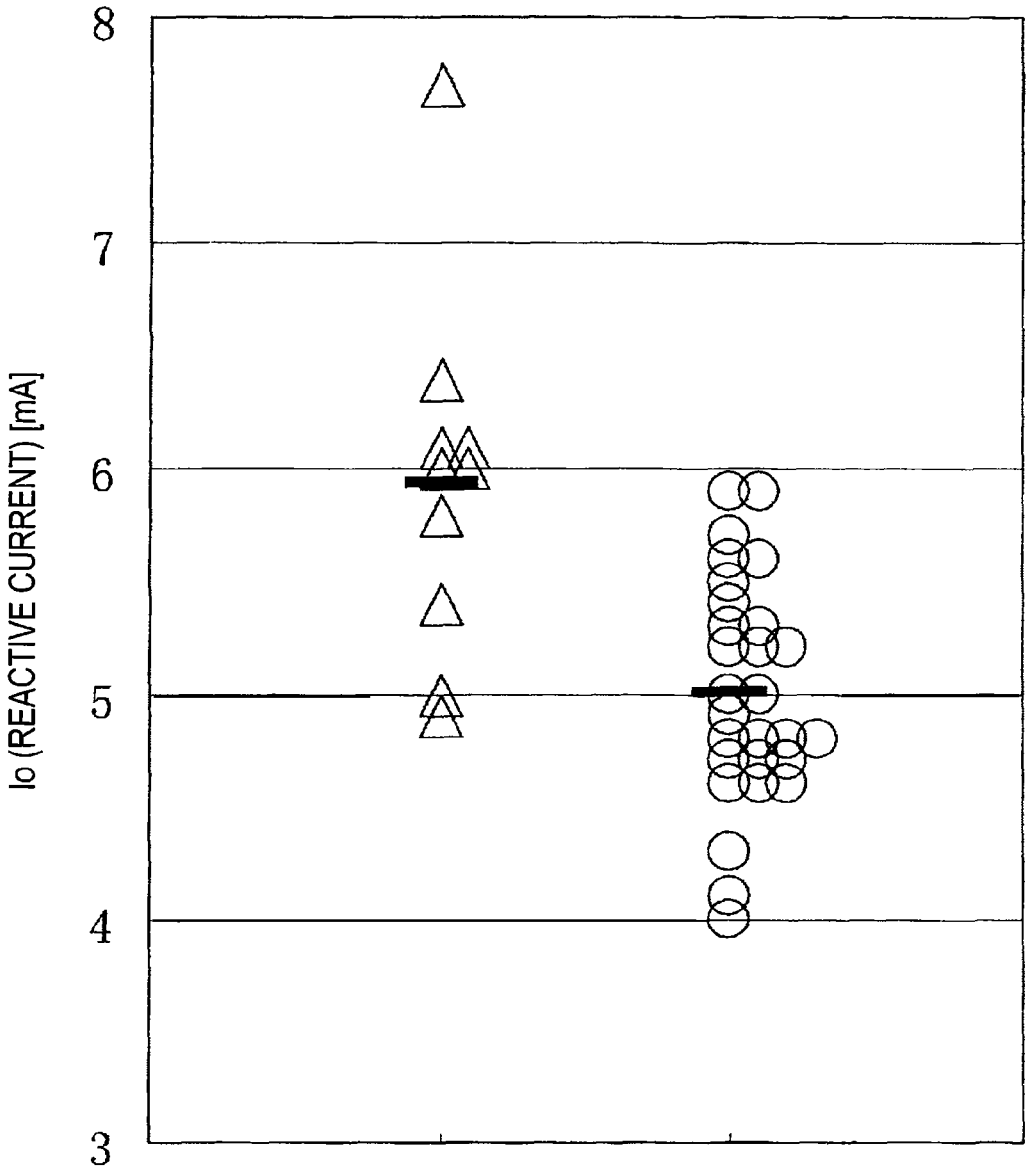
FIG. 5 is a diagram showing results of measurement of reactive currents [mA] in the samples of the magnetron 1 of the embodiment and the comparative sample examples.

FIG. 5 shows results of measurement of reactive currents [mA] in the samples of the magnetron 1 of the embodiment and the comparative sample examples. In FIG. 5, (outlined) circular symbols depict results of measurement of the samples of the magnetron 1 of the embodiment, and a horizontal bar depicts an average of the measurement results. Further, (outlined) triangular symbols in FIG. 5 depict results of measurement of reactive currents in the comparative sample examples, and an (outlined) horizontal bar depicts an average of the measurement results.

As shown in FIG. 5, variations in reactive current in the respective samples of the magnetron 1 of the embodiment are smaller than variations in reactive current in the respective comparative sample examples. Moreover, the average of reactive currents in the samples of the magnetron 1 of the embodiment is about 5.0 [mA] and smaller than the average (about 5.9 [mA]) of the reactive currents in the comparative sample examples.

Figure 6:
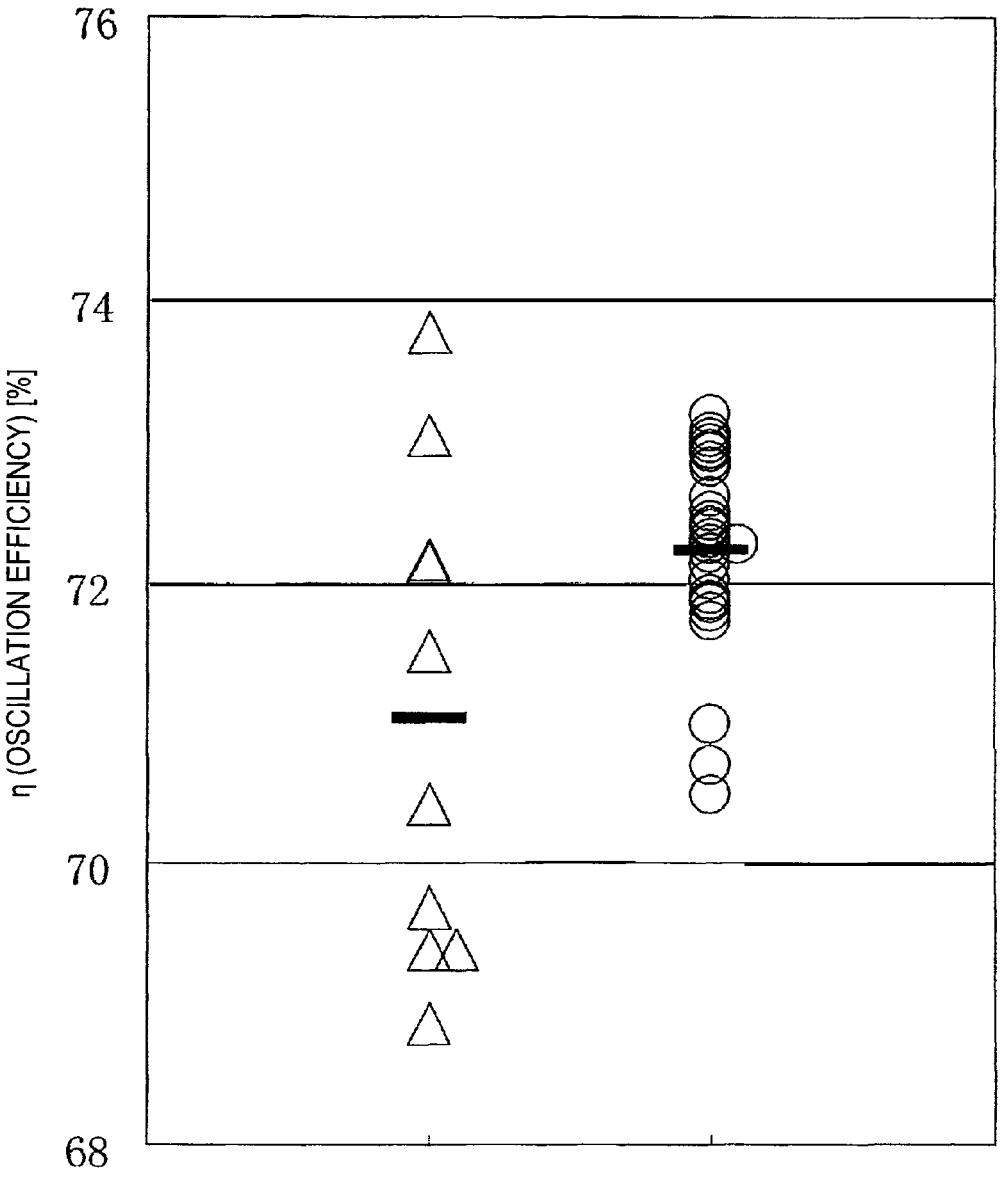
FIG. 6 is a diagram showing results of measurement of oscillation efficiency [%] of the samples of the magnetron 1 of the embodiment and the comparative sample examples.

FIG. 6 shows results of measurement of oscillation efficiency [%] of the samples of the magnetron 1 of the embodiment and the comparative sample examples. In FIG. 6, (outlined) circular symbols depict measurement results of the samples of the magnetron 1 of the embodiment, and a horizontal bar depicts an average of the measurement results. Further, (outlined) triangular symbols in FIG. 6 depict results of measurement of oscillation efficiency of the comparative sample examples, and an (outlined) horizontal bar depicts an average of the measurement results.

As shown in FIG. 6, variations in oscillation efficiency of the respective samples of the magnetron 1 of the embodiment are smaller than variations in oscillation efficiency of the respective comparative sample examples. Moreover, the average of oscillation efficiency of the samples of the magnetron 1 of the embodiment is about 72.2 [%] and greater than the average (about 71 [%]) of oscillation efficiency of the comparative sample examples.

Figure 7:
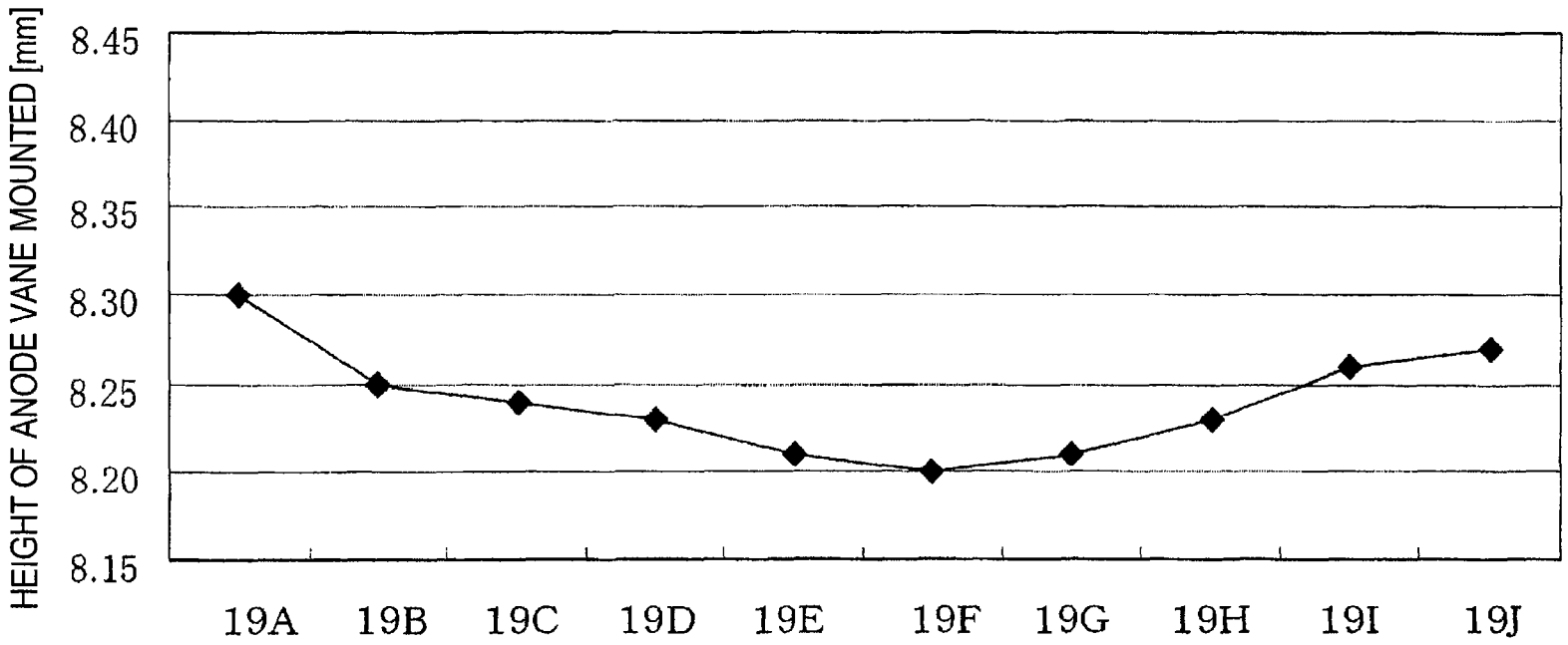
FIG. 7 is a diagram showing results of measurement of mounting heights of respective anode vanes 19A to 19J, in connection with the sample of the magnetron 1 of the embodiment that has exhibited a measurement result of highest oscillation efficiency.

Next, FIG. 7 shows results of measurement of mounting heights of the respective anode vanes 19A to 19J, in connection with the sample of the magnetron 1 of the embodiment that has exhibited a measurement result of highest oscillation efficiency. A vertical axis of FIG. 7 represents mounting heights of the respective anode vanes 19A to 19J, whereas a horizontal axis of FIG. 7 represents the respective anode vanes 19A to 19J by means of reference numerals 19A to 19J.

As represented by FIG. 7, mounting heights "h" of the respective anode vanes 19A to 19J of the sample of the magnetron 1 of the embodiment exhibited a measured result of the highest oscillation efficiency become lower stepwise from the anode vane 19A closest to the bent portion 26A of the center lead 26 to the anode vane 19F situated opposite the anode vane 19A on the inner peripheral surface of the anode cylinder 11.

Figure 8:
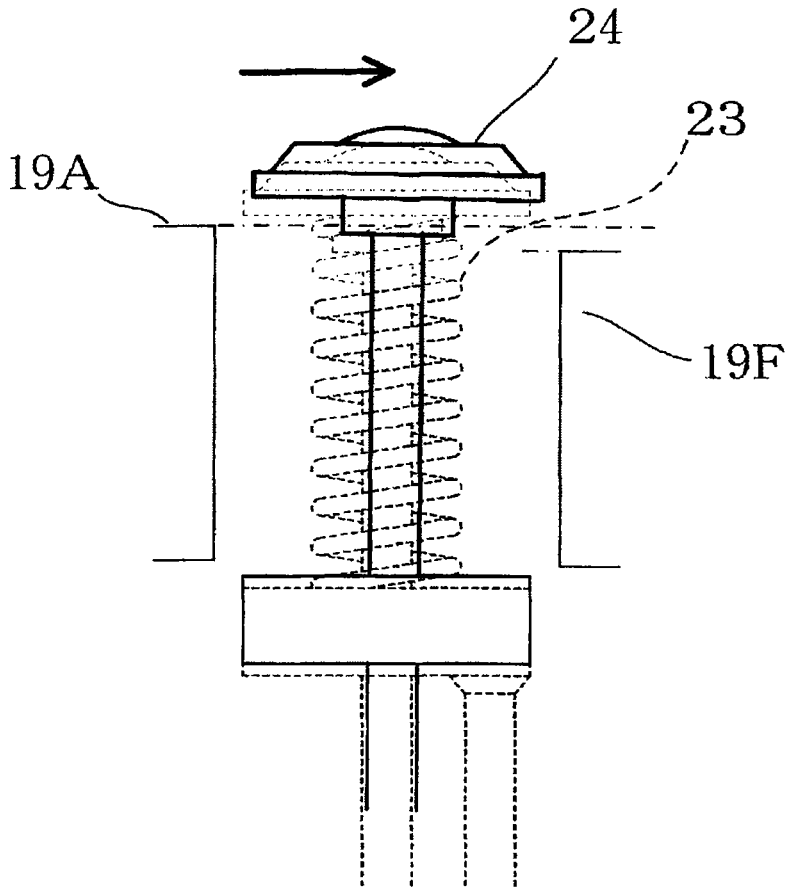
FIG. 8 is a diagram showing appearance of a cathode filament 23 before and during operation of the magnetron 1 of the embodiment.

The fact is described by reference to FIG. 8. FIG. 8 is a diagram showing appearance of the cathode filament 23 before and during operation of the magnetron 1 of the embodiment.

As shown in FIG. 8, when the magnetron 1 operates, the cathode filament 23 and the upper end shield 24 both of which are supported by the center lead become inclined, for reasons of displacement attributable to thermal expansion of the bent portion 26A of the center lead, from a position that is achieved before operation of the magnetron and that is indicated by a dotted line in the drawing, to a position achieved during operation of the magnetron. A component of a direction of inclination of the cathode filament 23 and the upper end shield 24 on a direction perpendicular to the axial direction of the anode cylinder 11 as indicated by an arrow in FIG. 8 coincides with the direction of the component (as indicated by the arrow shown in FIG. 1) of the curved direction of the bent portion 26A of the center lead 26 on the direction perpendicular to the axial direction. By reference to FIGS. 1 and 2, the anode vane 19F situated opposite the anode vane 19A on the inner peripheral surface of the anode cylinder 11 is placed, with respect to the anode vane 19A, at an imaginary extension of the direction of the component (as indicated by the arrow shown in FIG. 1) of the curved direction of the bent portion 26A of the center lead 26 on the direction perpendicular to the axial direction.

As mentioned above, in the magnetron 1 of the embodiment of the present invention, the component of a direction in which the cathode filament 23 becomes inclined on the direction perpendicular to the axial direction of the anode cylinder 11 coincides with the direction of the component (as indicated by the arrow shown in FIG. 1) of the curved direction of the bent portion 26A of the center lead 26 on the direction perpendicular to the axial direction. Therefore, when compared with the comparative example in which the plurality of anode vanes 19A to 19F are mounted at the same height, the magnetron 1 of the embodiment of the present invention exhibits high oscillation efficiency and can be operated at a small reactive current and with small unnecessary radiation.

As mentioned above, the magnetron 1 of the first embodiment has an anode cylinder on an inner peripheral surface of which a plurality of anode vanes are provided at a predetermined interval; a center lead including a first linear portion, a second linear portion that is parallel to the first linear portion and that is situated out of alignment with the first linear portion within a plane perpendicular to an axial direction of the anode cylinder, and a bent portion that connects the first linear portion to the second linear portion; and a cathode filament that is supported by the center lead within the anode cylinder and that is placed coaxially with the anode cylinder. The center lead is formed so as to become bent between the first linear portion and the second linear portion by means of the bent portion. The position of one anode vane closest to the bent portion is higher than the position of another anode vane with respect to the axial direction of the anode cylinder.

With this configuration, it is possible to suppress generation of a reactive current and noise, thereby enhancing oscillation efficiency.

In the magnetron 1 of the present embodiment, the plurality of anode vanes 19A to 19J are formed from the ten anode vanes 19A to 19J. The essential requirement for the anode vanes is that they be formed from an even number of anode vanes.

In the magnetron 1 of the present embodiment, even when the bent portion 26A of the center lead 26 is situated between two anode vanes in the axial direction of the anode cylinder 11, any one of the two anode vanes may be taken as one anode vane closest to the bent portion.

Although the embodiment of the present invention has been described, the present invention is not limited to the matter described in the embodiment. The present invention is also expected to be subjected to modifications and applications contrived by the artisans based on the descriptions of the present specification and the well known techniques, and the modifications and applications shall fall within a range where protection of the invention is sought.

The present invention is based on Japanese Patent Application (Application No. 2008-302771) filed on Nov. 27, 2008 in Japan, the entire contents of which are incorporated herein by reference.

INDUSTRIAL APPLICABILITY

The magnetron and the device using microwaves of the present invention provide an advantage of suppressing generation of a reactive current and noise thereby enhancing oscillation efficiency during operation of the magnetron, and are useful as a device using microwaves such as a microwave oven.

The invention claimed is:

1. A magnetron comprising:

an anode cylinder comprising a plurality of anode vanes disposed at a predetermined interval on an inner peripheral surface thereof;

a center lead comprising a first linear portion, a second linear portion which is disposed parallel to the first linear portion and which is disposed out of alignment with the first linear portion in a plane perpendicular to an axial direction of the anode cylinder, and a bent portion which connects the first linear portion to the second linear portion; and a cathode filament which is supported by the center lead within the anode cylinder and which is placed coaxially with the anode cylinder, wherein the center lead is formed so as to become bent between the first linear portion and the second linear portion by the bent portion, and wherein a position of one anode vane closest to the bent portion is higher than a position of another anode vane with respect to the axial direction of the anode cylinder.

2. The magnetron according to claim 1, wherein an antenna lead is connected to the one anode vane.

3. A device using microwaves comprising the magnetron according to claim 1.

4. A magnetron comprising:

an anode cylinder comprising a plurality of anode vanes disposed at a predetermined interval on an inner peripheral surface thereof;

a center lead comprising a first linear portion, a second linear portion which is disposed parallel to the first linear portion and which is disposed out of alignment with the first linear portion in a plane perpendicular to an axial direction of the anode cylinder, and a bent portion which connects the first linear portion to the second linear portion; and a cathode filament which is supported by the center lead within the anode cylinder and which is placed coaxially with the anode cylinder, wherein the center lead is formed so as to become bent between the first linear portion and the second linear portion by the bent portion, wherein a position of one anode vane closest to the bent portion is higher than a position of another anode vane with respect to the axial direction of the anode cylinder, and wherein positions of the plurality of anode vanes become lower stepwise in the axial direction of the cylindrical anode from the one anode vane to the another anode vane.

5. The magnetron according to claim 4, wherein when the magnetron operates, a component of a direction in which the cathode filament becomes inclined because of thermal expansion of the bent portion of the center lead on a direction perpendicular to the axial direction of the anode cylinder is identical with a component of a curved direction of the center lead on the direction perpendicular to the axial direction.

6. The magnetron according to claim 4, wherein an antenna lead is connected to the one anode vane.

7. A device using microwaves comprising the magnetron according to claim 4.

8. A magnetron comprising:

an anode cylinder comprising a plurality of anode vanes disposed at a predetermined interval on an inner peripheral surface thereof;

a center lead comprising a first linear portion, a second linear portion which is disposed parallel to the first linear portion and which is disposed out of alignment with the first linear portion in a plane perpendicular to an axial direction of the anode cylinder, and a bent portion which connects the first linear portion to the second linear portion; and a cathode filament which is supported by the center lead within the anode cylinder and which is placed coaxially with the anode cylinder, wherein the center lead is formed so as to become bent between the first linear portion and the second linear portion by the bent portion, wherein a position of one anode vane closest to the bent portion is higher than a position of another anode vane with respect to the axial direction of the anode cylinder, and wherein when the magnetron operates, a component of a direction in which the cathode filament becomes inclined because of thermal expansion of the bent portion of the center lead on a direction perpendicular to the axial direction of the anode cylinder is identical with a component of a curved direction of the center lead on the direction perpendicular to the axial direction.

9. The magnetron according to claim 8, wherein positions of the plurality of anode vanes become lower stepwise in the axial direction of the cylindrical anode from the one anode vane to the another anode vane.

10. The magnetron according to claim 8, wherein an antenna lead is connected to the one anode vane.

11. A device using microwaves comprising the magnetron according to claim 8.

* * * * *